US010488791B2

(12) United States Patent
Hirose et al.

(10) Patent No.: US 10,488,791 B2
(45) Date of Patent: Nov. 26, 2019

(54) IMAGE FORMING APPARATUS HAVING A CONTROLLER THAT CHANGES A THROUGHPUT OF A RECORDING MATERIAL OF A SIZE IF THE APPARATUS RECEIVES A PRINTING INSTRUCTION FOR PRINTING ON A RECORDING MATERIAL OF ANOTHER SIZE

(71) Applicant: CANON KABUSHIKI KAISHA, Tokyo (JP)

(72) Inventors: Masaki Hirose, Suntou-gun (JP); Satoru Taniguchi, Mishima (JP); Takashi Honke, Mishima (JP); Hirohiko Aiba, Suntou-gun (JP); Taisuke Minagawa, Suntou-gun (JP); Mahito Yoshioka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/041,012

(22) Filed: Jul. 20, 2018

(65) Prior Publication Data

US 2019/0025744 A1 Jan. 24, 2019

(30) Foreign Application Priority Data

Jul. 21, 2017 (JP) ..... 2017-141665

(51) Int. Cl.
*G03G 15/20* (2006.01)
*G03G 15/00* (2006.01)

(52) U.S. Cl.
CPC ..... *G03G 15/2039* (2013.01); *G03G 15/2042* (2013.01); *G03G 15/5008* (2013.01);
(Continued)

(58) Field of Classification Search
CPC ..... G03G 15/2039–205; G03G 2215/2045
See application file for complete search history.

(56) References Cited

U.S. PATENT DOCUMENTS 7,630,662 B2 12/2009 Namiki et al.
8,331,819 B2 12/2012 Fukuzawa et al.
(Continued)

FOREIGN PATENT DOCUMENTS

JP H07-191571 A 7/1995
JP H10-142975 A 5/1998
JP 2014-035472 A 2/2014

*Primary Examiner* — Carla J Therrien
(74) *Attorney, Agent, or Firm* — Venable LLP

(57) ABSTRACT

An image forming apparatus includes an image forming portion configured to form a toner image on a recording material, a fixing portion configured to heat and to fix the toner image formed on the recording material, and a controller configured to control the apparatus, which is operable to form an image on a recording material having a first size and a recording material having a second size smaller than the first size in a direction perpendicular to a recording material feeding direction. If a printing instruction for printing on the recording material of the first size is received while continuously printing on the recording material of the second size at a first throughput, the controller controls the apparatus so as to print on the recording material of the second size at a second throughput, lower than the first throughput, before printing on the recording material of the first size.

19 Claims, 8 Drawing Sheets

(52) U.S. Cl.
CPC ..... *G03G 15/5062* (2013.01); *G03G 15/55* (2013.01); *G03G 15/6594* (2013.01); *G03G 2215/00949* (2013.01)

(56) References Cited

U.S. PATENT DOCUMENTS

| | | | | |
|---|---|---|---|---|
| 8,744,296 | B2 | 6/2014 | Fukuzawa et al. | |
| 2014/0314458 | A1* | 10/2014 | Mitani ..... | G03G 15/2017 399/329 |
| 2018/0284667 | A1* | 10/2018 | Iesaki ..... | G03G 15/2039 |

* cited by examiner

IMAGE FORMING APPARATUS HAVING A CONTROLLER THAT CHANGES A THROUGHPUT OF A RECORDING MATERIAL OF A SIZE IF THE APPARATUS RECEIVES A PRINTING INSTRUCTION FOR PRINTING ON A RECORDING MATERIAL OF ANOTHER SIZE

This application claims the benefit of Japanese Patent Application No. 2017-141665, filed on Jul. 21, 2017, which is hereby incorporated by reference herein in its entirety.

FIELD OF THE INVENTION AND RELATED ART

The present invention relates to an image forming apparatus, such as a copying machine and a printing machine, for forming a toner image on a sheet of recording medium with the use of an electrophotographic recording technology.

As a substantial number of small prints are output in succession by an image forming apparatus, which employs a fixing device, the portions of a fixing nip, which are out-of-sheet-path portions, gradually overheat. Hereafter, this phenomenon will be referred to as "out-of-sheet-path overheating". It is likely that, as the out-of-sheet-path portions of the fixation nip overheat, various internal parts (fixing members that form fixation nip) of the fixing apparatus are damaged. Further, it sometimes occurs that as a large sheet (sheets) of recording medium is conveyed through the fixing device right after the successive conveyance of a substantial number of small sheets of recording medium, the toner particles on the out-of-sheet-path portions of the large sheet of recording medium, are excessively heated, and are offset onto the abovementioned rotational members (fixation film, for example) of a fixing device. Hereafter, this phenomenon may be referred to as "high temperature offset".

In recent years, the fixing portion of a fixing apparatus has been progressively decreased in thermal capacity, in order to reduce an image forming apparatus in First Print Out Time (FPOT), and also, to reduce an image forming apparatus in energy consumption. This means that the fixing members of a recent fixing device are likely to quickly increase in temperature even when the amount by which heat is given to them is relatively small. Thus, the out-of-sheet-path portions of a recent fixing device are likely to increase in temperature faster than those of a conventional fixing device, because they are lower in thermal capacity than the counterparts of a conventional fixing device. This is undesirable from the standpoint of minimizing the out-of-sheet-path overheating.

Further, in recent years, an image forming apparatus has been substantially increased in printing speed. As an image forming apparatus has been increased in speed, it has become more likely for the out-of-sheet-path portions of a fixing device to overheat, for the following reason. That is, the shorter the length of time it takes for a sheet of recording medium to pass through the fixing portion, the greater the amount by which the fixing device (heating portion) needs to be supplied with electrical power per unit length of time, and, therefore, the greater the amount of the heat given to the out-of-sheet-path portion per unit of length of time. Moreover, as an image forming apparatus has been increased in printing speed, it has become shorter in the sheet interval in an image forming operation in which two or more prints are output in succession. Thus, it has become less likely for the portion of the fixation nip, which corresponds in position to the sheet path, and the portions of the fixation nip, which are out of the sheet path, to become practically equal in temperature with each other, during the sheet interval. Here, "sheet interval" means the length of time between when the trailing end of the preceding sheet of recording medium comes out of the fixation nip, and when the leading end of the immediately subsequent sheet of recording medium enters the fixation nip, in an image forming operation in which two or more prints are output in succession.

One of the means for minimizing the out-of-sheet-path overheating is proposed in Japanese Laid-open Patent Application No. H07-191571. According to this patent application, if it is determined, at the beginning of an image forming operation, that the out-of-sheet-path portions of the fixation nip are excessively high in temperature, such a process as idling the fixation roller is carried out to make the sheet-path portion of the fixation nip and the out-of-sheet-path portions of the fixation nip roughly equal in temperature.

As an image forming apparatus is increased in printing speed, however, the length of time it takes to make the fixing nip more or less uniform in temperature in terms of its lengthwise direction becomes relatively longer compared to the actual length of time it takes to output prints. Thus, the total length of time it takes to finish an image forming operation in which a certain number of large prints are output after a substantial number of small prints are output becomes substantially longer than the length of time it takes when the image forming apparatus is conventionally operated. That is, proposals such as the abovementioned one are problematic in that they substantially reduce an image forming apparatus in productivity.

SUMMARY OF THE INVENTION

Thus, the primary object of the present invention is to provide an image forming apparatus that can output high quality images, while remaining virtually the same in productivity as it is in an ordinary image forming operation, even in an image forming operation in which large sheets of recording medium are conveyed through the fixation nip immediately after a substantial number of small sheets of recording medium are conveyed through the fixation nip in succession.

According to one aspect, the present invention provides an image forming apparatus comprising an image forming portion configured to form a toner image on a recording material, a fixing portion configured to heat and fix the toner image formed on the recording material, and a controller configured to control the apparatus, which is operable to form an image on the recording material having a first size and the recording material having a second size smaller than the first size, wherein, when a print instruction on the recording material of the first size is received during a period in which a print is formed on the recording material of the second size at a first throughput, the controller controls the apparatus so as to print on the recording material of the second size at a second throughput, which is lower than the first throughput.

Further features of the present invention will become apparent from the following description of exemplary embodiments with reference to the attached drawings.

DESCRIPTION OF THE EMBODIMENTS

Hereafter, a few of preferred embodiments of the present invention are described with reference to appended drawings.

Embodiment 1

Image Forming Apparatus 100

Figure 1:
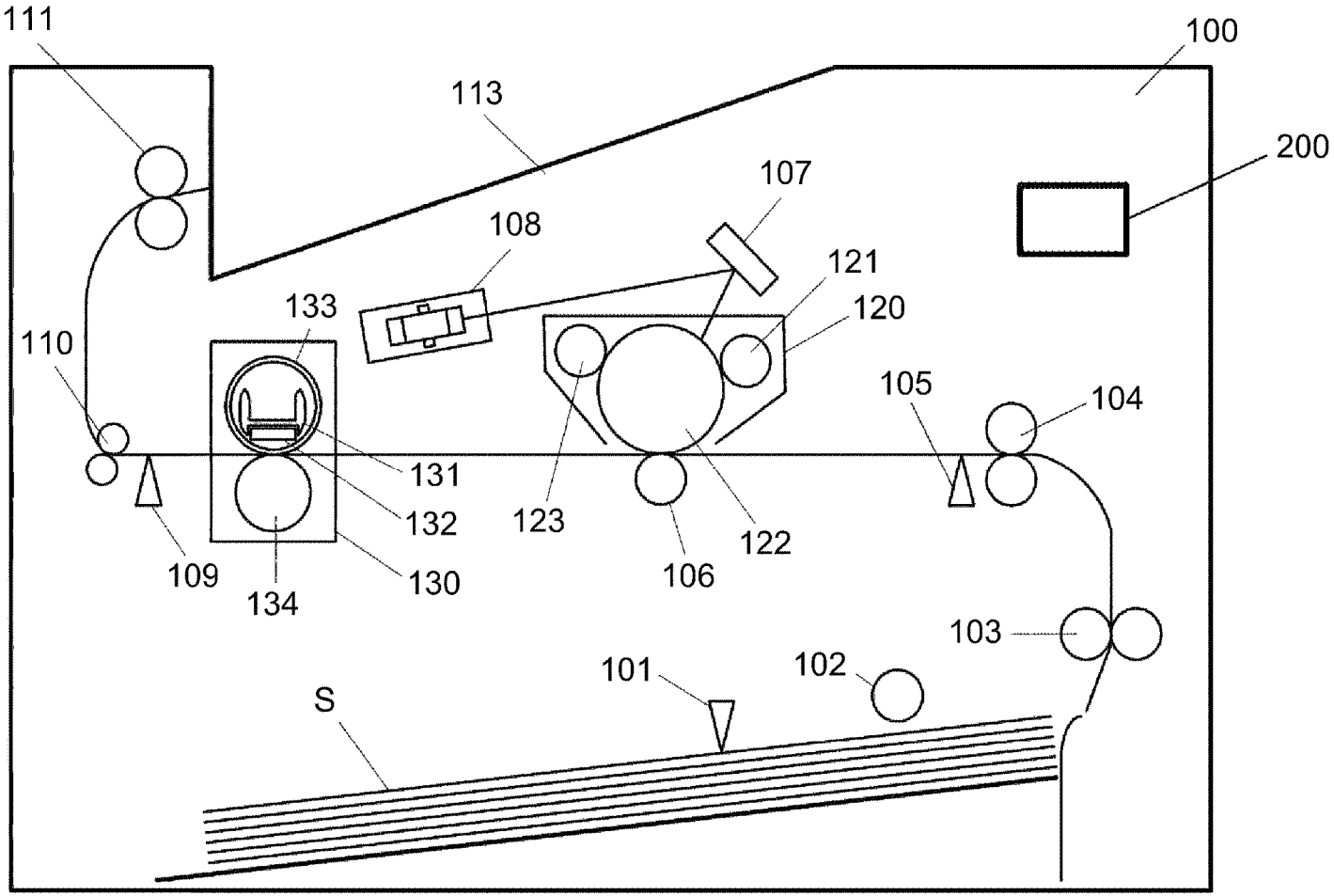
FIG. 1 is a sectional view of the image forming apparatus in the first embodiment of the present invention, and shows the overall structure of the apparatus.

FIG. 1 is a sectional view of the image forming apparatus 100 in this embodiment. It shows the overall structure of the apparatus 100. First, referring to FIG. 1, the overall structure and printing operation (image forming operation) of this image forming apparatus 100 are described.

The image forming apparatus 100 in this embodiment employs a toner cartridge 120, which is removably mountable in the main assembly of the apparatus 100. The toner cartridge 120 is provided with a development roller 121, a photosensitive drum 122, and a charge roller 123. It is one of the members that make up the toner image forming portion of the apparatus 100.

As a printing operation is started, first, the peripheral surface of the photosensitive drum 122 is uniformly charged to a preset potential level by the charge roller 123. To the uniformly charged portion of the photosensitive drum 122, a beam of laser light, which is output from an optical box 108 (laser) and is deflected by a mirror 107, is projected. This beam of laser light is such a beam of laser light that is output by the optical box 108 while being modulated (turned on or off), in accordance with the information that is related to the image to be formed, and that is input from an apparatus (unshown), such as an image reading apparatus and a computer.

More concretely, the uniformly charged portion of the peripheral surface of the photosensitive drum 122 is scanned (exposed) by the beam of laser light. Consequently, a latent image (electrostatic latent image) that reflects the information of the image to be formed, is formed on the peripheral surface of the photosensitive drum 122. The timing with which the peripheral surface of the photosensitive drum 122 begins to be scanned in the secondary direction is given by secondary scanning timing synchronization signals given from the image forming apparatus 100 to the image formation signal generating apparatus. The latent image formed in accordance with the information of the image to be formed is developed by the development roller 121.

Next, as it is detected by a recording medium (recording paper) sensor 101 that sheets S of recording medium are present in a sheet feeder cassette, one of the sheets S is fed into the main assembly of the image forming apparatus 100 by a feed roller 102. Then, the sheet S is conveyed further by a conveyance roller 103, and a pair of registration rollers 104. As the sheet S is conveyed, the leading edge of the sheet S is detected by an edge sensor 105 to convey the sheet S further with such timing that the sheet S arrives at the transfer nip, which is the nip between the photosensitive drum 122 and a transfer roller 106, at the same time as the toner image on the peripheral surface of the photosensitive drum 122.

The transfer roller 106 is for transferring a toner image from the photosensitive drum 122 onto the sheet S. More specifically, as electrical charge, which is different in polarity from the normal toner charge, is applied to the sheet S from the back side of the sheet S by the transfer roller 106, the toner image is transferred from the photosensitive drum 122 onto the sheet S. After the transfer of the toner image onto the sheet S, the sheet S is separated from the photosensitive drum 122, and then, is sent to a fixing portion 130, through which it is conveyed. As the sheet S is conveyed through the fixing portion 130, it is heated and pressed. Consequently, the unfixed toner image on the sheet S becomes fixed to the sheet S. The fixing portion 130 has a guiding member 131, a heater 132, a film 133 (endless belt), and a pressure roller 134, as will be described later.

After the fixation of the toner image to the sheet S, the sheet S is conveyed out of the fixing portion 130, and then, is conveyed further. Then, the leading edge of the sheet S is detected by a discharge sensor 109. Then, the sheet S is conveyed further by a pair of FU rollers 110 and a pair of FD rollers 111, and is discharged into a FD tray 113 (delivery tray), ending the printing sequence.

As for the specifications of the image forming apparatus 100 in this embodiment, the image forming apparatus 100 is 160 mm/sec in process speed, and is 15 ppm (when the recording medium is a small sheet S (envelope) of COM10 size). Here, "throughput" means the number of images (prints) that the image forming apparatus 100 can output per unit length of time (a number of images that the fixing portion 130 can fix per unit length of time). In terms of the recording medium conveyance direction, the dimension of the widest sheet on which this image forming apparatus 100 can form an image is 210 mm (which is equivalent to width of sheet of recording medium of A4 size when it is conveyed in portrait mode). When a sheet of recording medium of A4 size is conveyed in portrait mode, the throughput of the image forming apparatus 100 is 60 ppm.

Fixing Portion 130

Next, the fixing portion 130 of the image forming apparatus 100 in this embodiment is described.

An image forming apparatus 100 equipped with a fixing portion 130 can accommodate various recording mediums (recording papers (sheets)) that are different in dimension in terms of the widthwise direction, that is, the direction that is perpendicular to the direction in which a sheet of recording medium (paper) is conveyed through the fixing portion 130 (image forming apparatus 100). Hereafter, the widest sheet of recording paper that the image forming apparatus 100 can accommodate is referred to as a "large sheet S of paper", whereas any sheet of recording paper, which is narrower than the large sheet S of paper, is referred to as a "small sheet S of paper". Further, the excessive amount of temperature increase that occurs to the lengthwise end portions of each of a pair of fixing members that form the nip, as a substantial number of small prints are outputted in succession, is referred to as "out-of-sheet-path overheating".

Figure 2:
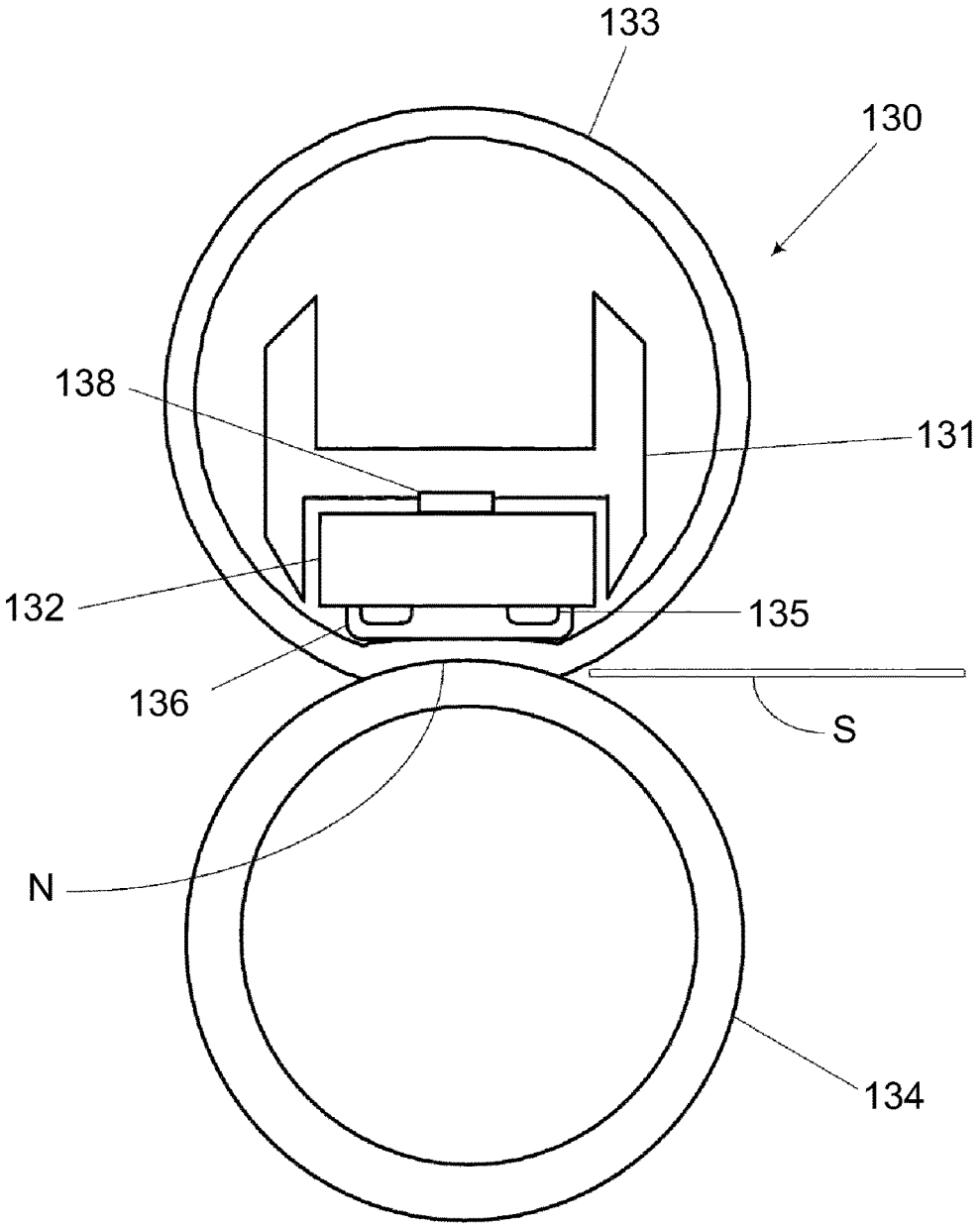
FIG. 2 is a sectional view of the fixing portion of the so-called film-heating type in the first embodiment, and shows the overall structure of the heating portion.

FIG. 2 is a sectional view of the fixing portion 130 of the film-heating type. It shows the overall structure of the fixing portion 130. The fixing portion 130 has a heater 132 (heating member), a guiding member 131 (holding member) for holding the heater 132, a heat-resistant endless (cylindrical) film 133 (first rotational member) fitted around the guiding member 131, and a pressure roller 134 (second rotational member) as a pressing member. The area of contact between the film 133 and pressure roller 134 is the fixation nip N (which hereafter may be referred to simply as nip N), which corresponds in position to where the heater 132 faces the inward surface of the film 133.

Here, a combination of the film 133, which is referred to as the first fixing member, and the pressure roller 134, which is referred to as the second fixing member, is equivalent to a pair of rotational members that form the nip N by being pressed upon each other. Further, the heater 132 is in contact with the inward surface of the film 133. Next, each of the structural components of the fixing portion 130 is described.

(1) Guiding Member 131

The guiding member 131 is formed of heat resistant resin. Not only does it support the heater 132, but also, it doubles as a conveyance guide for the film 133. As the materials for the guiding member 131, highly heat resistant resin, such as polyimide, polyamideimide, polyether-ether-ketone (PEEK), polyphenylene-sulfide (PPS), and liquid polymer, which are easily processable, are usable. Further, composite materials made of these resins, ceramics, metals, glasses, etc., can also be usable. In this embodiment, liquid polymer was used.

(2) Heater 132

The heater 132 is a ceramic heater. As the heater substrate, a ceramic substrate (which hereafter will be referred to simply as substrate), which is excellent in terms of thermal conductivity and is dielectric, is used. It is made of such ceramic as alumina and aluminum nitride. From the standpoint of reducing the substrate in thermal capacity, the thickness of the substrate is desired to be in a range of roughly 0.5 mm to 1.0 mm. The substrate is rectangular, and is roughly 10 mm in width and roughly 300 mm in length.

The heater 132 has a heat-generating resistor 135, which is borne by one of the pair of largest surfaces of the substrate, extending in the lengthwise direction of the substrate. The main ingredient of the heat-generating resistor 135 is silver-palladium alloy, nickel-tin alloy, ruthenium oxide alloy, or the like. It is roughly 10 μm in thickness, and roughly 1 mm to 5 mm in width. It is formed on the substrate by screen printing, or a like method.

Further, the heater 132 is provided with a glass layer 136 as an electrically insulative layer, which covers the top side of the heat-generating resistor 135. Not only does the glass layer 136 insulate the electrically conductive layer of the film 133 from the heat-generating resistor 135, but also, it plays the role of preventing the heat-generating resistor 135 from suffering from mechanical damages. The thickness of the glass layer 136 is desired to be in a range of 20 μm to 100 μm. The glass layer 136 plays also the role of a layer on which the film 133 slides.

(3) Film 133

The film 133, which is an endless belt, is fitted around the guiding member 131 by which the heater 132 is held. The relationship between the dimension of the film 133 and that of the guiding member 131 is such that the dimension of the inward surface of the film 133 in terms of its rotational direction is greater than the circumference of the theoretical cylinder, which circumscribes the guiding member 131, by which the heater 132 is held. Thus, the film 133 loosely fits around the guiding member 131.

The film 133 has to be capable of efficiently transferring the heat from the heater 132 to a sheet S of recording medium as an object to be heated. Thus, it is formed of a single-layer film formed of heat resistant resin, such as polytetrafluoroethylene (PTFE), a coplymer of tetrafluoroethyline and perfluoroalkylvinylether (PFA), or a coplymer of tetrafluoroethylene and hexafluoropropyrene (FEP), or a multilayer film formed of two or more of these resins. It is roughly 20 μm to 70 μm in thickness. The material for the substrative layer of the film 133 is a resin, such as polyimide, polyamideimide, PEEK, polyethersulfone (PES), and PPS, or a metal, such as stainless use steel (SUS).

The film 133 is provided with an elastic layer, which is a layer of silicone rubber in which a thermally conductive filler, such as ZnO, A1202, SiC, and metallic silicon, is dispersed. Further, it has a surface layer formed on the elastic layer by coating the elastic layer with PTFE, PFA, FEP, or the like.

The film 133 in this embodiment is provided with a substrative layer, an elastic layer, and a surface layer. The substrative layer is 50 μm in thickness, and is formed of an electrically conductive compound made by mixing electrically conductive filler in polyimide. The elastic layer is 240 μm in thickness, and is formed of a compound made by mixing metallic silicon into silicone rubber. The surface layer is formed by coating the elastic layer (silicone rubber layer) with PTFE.

(4) Pressure Roller 134

The pressure roller 134 is such a member that forms the nip N between itself and the film 133 by being pressed against the heater 132 with the presence of the film 133 between itself and heater 132. It functions also as a member for rotationally driving the film 133. It is an elastic roller. It has a metallic core formed of SUS, stainless use metal (SUM), aluminum (Al), or the like, an elastic layer formed on the peripheral surface of the metallic core of heat resistant rubber, such as silicone rubber, fluorine rubber, or an elastic layer formed on the peripheral surface of the metallic core of foamed silicone rubber, and a release layer formed on the peripheral surface of the elastic layer, of PFA, PTFE, PEP, or the like. In this embodiment, the material for the metallic core was aluminum. The elastic layer was formed of silicone rubber, and was 4.0 mm in thickness. The release layer was formed of PFA, and was 50 μm in thickness.

(5) Thermistor 138

A thermistor 138 is an element as a temperature detecting means for detecting the temperature of the ceramic heater 132. The temperature detected by the thermistor 138 is input into an engine controller (unshown). It is of the Negative Temperature Coefficient (NTC) type. That is, it reduces in resistance as temperature rises.

The temperature of the ceramic heater 132 is watched by the engine controller. The engine controller compares the detected temperature of the ceramic heater 132 with a target temperature level set in the engine controller, and adjusts the amount by which electrical power is supplied to the heater 132. That is, the electrical power to be supplied to the heater 132 is controlled so that the temperature of the heater 132 remains at a target level.

Equalization Process (Cooling Process)

As will be described later, in this embodiment, in a case in which a large sheet of recording paper is conveyed through the fixing portion 130 immediately after a substantial number of small sheets of recording paper are conveyed through the fixing portion 130 in succession, an operation (equalization process) for cooling the overheated out-of-sheet-path portion of the fixing portion 130, before the large sheet of recording paper begins to be conveyed, after the continuous conveyance of the small sheets of recording paper end, is performed. The definition of equalization process is as follows. The equalization process in this embodiment is such a process that rotates the film 133 and the pressure roller 134 while the temperature of the heater 132 is kept lower than the target level of the fixation process. It may be referred to as equalization rotation.

Figure 3:
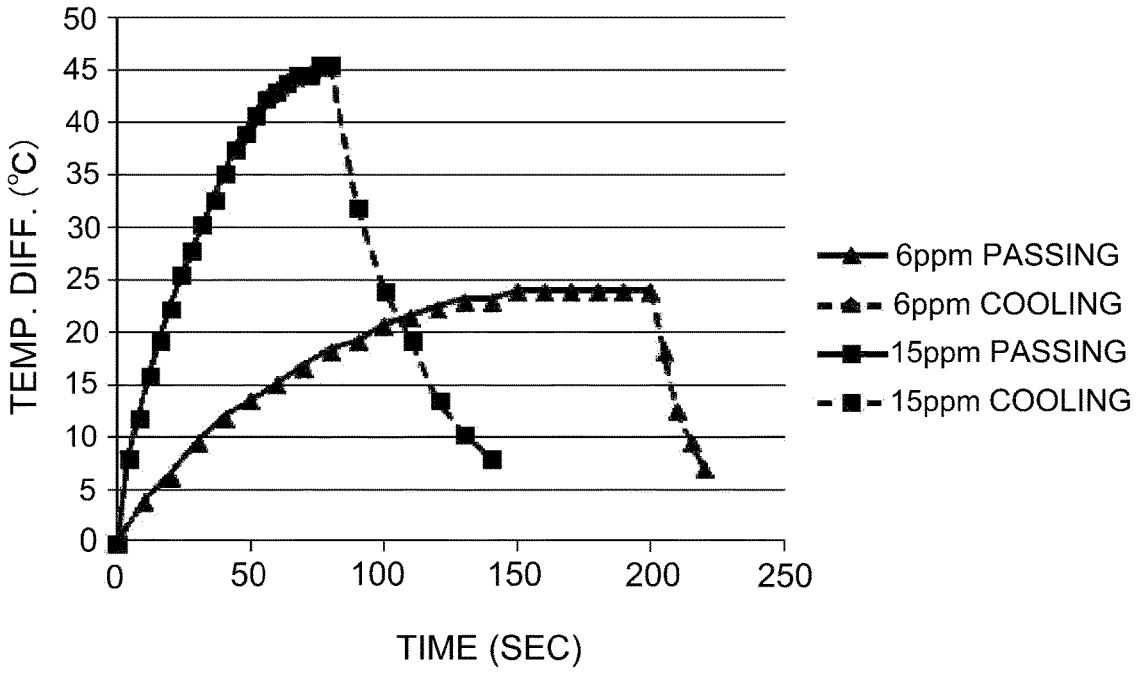
FIG. 3 is a graph showing the relationship between the temperature difference between the sheet-path portion and out-of-sheet-path portion of the fixing portion, and the elapsed length of time, while images are actually formed, and while the fixing portion is cooled (equalization process).

FIG. 3 is a graph that shows the relationship between the temperature difference between the sheet-path and out-of-sheet-path portions of the film 133, and the length of time that elapsed while two hundred envelopes of the COM10 size (small), which is 104.7 mm in width, were conveyed through the fixing portion 130 in succession. For example, when two hundred envelopes were conveyed at a throughput of 5 ppm (4 sec/sheet), it took 80 seconds to convey all of them. At the end of the conveyance of two hundred small envelopes, the temperature difference was roughly 45° C. If a large sheet of recording paper (A4 size), which is 210 mm in width, is conveyed through the fixing portion 130, and is conveyed in this condition, "high temperature offset" occurs across the areas that correspond in position to the out-of-sheet-path portions of the film 133, which occurs as a substantial number of small sheet of recording paper (COM10 size) are conveyed.

In this embodiment, in order to prevent the occurrence of high temperature offset, the equalization (cooling) process for making the film 133 uniform in temperature in terms of its widthwise direction is carried out before a large (210 mm in width) sheet S of paper begins to be conveyed after the continuous conveyance of a substantial number of small sheets S of paper. As a means for making the film 133 uniform in temperature in terms of its widthwise direction, it is effective to keep an image forming apparatus 100 on standby immediately after the conveyance of a substantial number of small sheets S of paper, until the temperature of the out-of-sheet-path portions of the film falls by certain degrees. If the image forming apparatus 100 is kept on standby without rotating the film 133, however, it takes a substantial length of time for the temperature of the out-of-sheet-path portions of the film to substantially reduce. In comparison, if the temperature of the heater is kept at a level that is lower than the one for the fixation process while keeping the film 133 and the pressure roller 134 rotating, it takes less time to reduce the temperature of the overheated out-of-sheet-path portions of the film than if the image forming apparatus 100 is kept on standby without rotating the film 133 and the pressure roller 134.

By the way, it has been known that, in the case of this apparatus, if the temperature difference between the sheet-path portion and out-of-sheet-path portions of the film is kept no more than 10° C., high temperature offset does not occur. For example, when the fixing portion 130 was cooled for 60 seconds after twenty envelopes (which is equivalent to twenty small sheets S of paper) were continuously conveyed through the fixing portion 130 at a throughput of 15 ppm, the temperature difference between the sheet-path portion and out-of-sheet-path portions of the film became roughly 8° C. Thus, when a large sheet (A4 size) of paper was conveyed through the fixing portion 130, high temperature offset did not occur. In this case, the total length of time it took to complete the image forming operation was 140 seconds (80 seconds+60 seconds).

In comparison, if all of twenty envelopes (which is equivalent to twenty small sheets S of paper) were continuously conveyed through the fixing portion 130 at a throughput of 6 ppm (10 seconds per sheet), that is, with sheet interval set longer, it takes 200 seconds. Here, "sheet interval time" means the length of time it takes for the leading edge of the following sheet S of paper to enter the nip N after the trailing edge of the preceding sheet comes out of the nip N when two or more prints are made in succession. More concretely, it is the length of time that elapses between when the trailing edge of the preceding sheet of recording medium comes out of the nip of the pair of registration rollers 104 (FIG. 1), and when the leading edge of the following sheet of recording medium (paper) reaches the same pair of registration rollers 104.

In this case, after the last sheet S of paper came out of the nip N, the temperature difference between the sheet-path portion and out-of-sheet-path portions of the film was roughly 24° C. Then, the equalization process (cooling process) was carried out for 20 seconds. Consequently, the temperature difference between the sheet-path and out-of-sheet-path portions of the film became roughly 9° C. Thus, when a large sheet (A4 size) of paper was conveyed through the fixing portion 130, high temperature offset did not occur. In this case, the total length of time it took to complete the printing operation was 220 seconds (200 seconds+20 seconds).

This total length of time of 220 seconds is longer than the abovementioned total length of time of 140 seconds, which it took to carry out the equalization process (cooling process) after all of twenty small sheets of paper were continuously conveyed through the fixing portion 130 at a throughput of 15 ppm. If the equalization process (cooling process) is carried out for the period in which only a preset number of the last sheets S of paper are conveyed through the fixing portion 130, however, the total length of time is 118 seconds, which is substantially shorter than 140 seconds. This matter will be described later in detail.

Here, referring to FIG. 3, there are two reasons why the latter case (6 ppm in throughput) is smaller in the temperature difference between the sheet-path and out-of-sheet-path portions of the film 133 immediately after the completion of the conveyance of the small sheets S of paper (before the cooling process is started). First, when the throughput is 15 ppm, the sheet interval time is 2.5 second (4 seconds less 1.5 seconds), whereas when the throughput is 6 ppm, the sheet interval time is 8.5 seconds (10 seconds less 1.5 seconds). Therefore, the temperature difference is more likely to be reduced in the latter case. Second, the longer the sheet interval time, the more likely it is for the pressure roller 134 to increase in temperature, and, therefore, the smaller the amount of electrical power necessary for fixation.

Therefore, the temperature difference between the sheet-path and out-of-sheet-path portions of the film 133 is smaller, and, therefore, is shorter in the length of time necessary for the equalization process (cooling process), when the envelopes of COM10 size are conveyed at a throughput of 6 ppm than at a throughput of 15 ppm.

Based on this background knowledge, it is evident that in a case in which a large sheet S of paper is conveyed through the fixing portion 130 immediately after a substantial number of small sheets are continuously conveyed through the fixing portion 130, the lower the image forming apparatus 100 is in throughput, the shorter the length of time required for the equalization process (cooling process). On the other hand, in a case in which no large sheet S of paper is conveyed through the fixing portion 130 after the conveyance of successive conveyance of a substantial number of small sheets S of paper through the fixing portion 130, the higher the image forming apparatus 100 is in throughput, the higher the apparatus is in productivity. In this embodiment, therefore, the image forming apparatus 100 is reduced in throughput for a preset number of last small sheets S of paper, only if a printing signal for printing on a large sheet S of paper is received while printing is continuously performed on a substantial number of small sheets S of paper. With the implementation of this procedure, it is possible to reduce the length of time required for the equalization process (cooling process), and also, to reduce the total length of time required for the completion of the image forming operation.

Throughput-Down Control (Throughput-Down Control)

Figure 4:
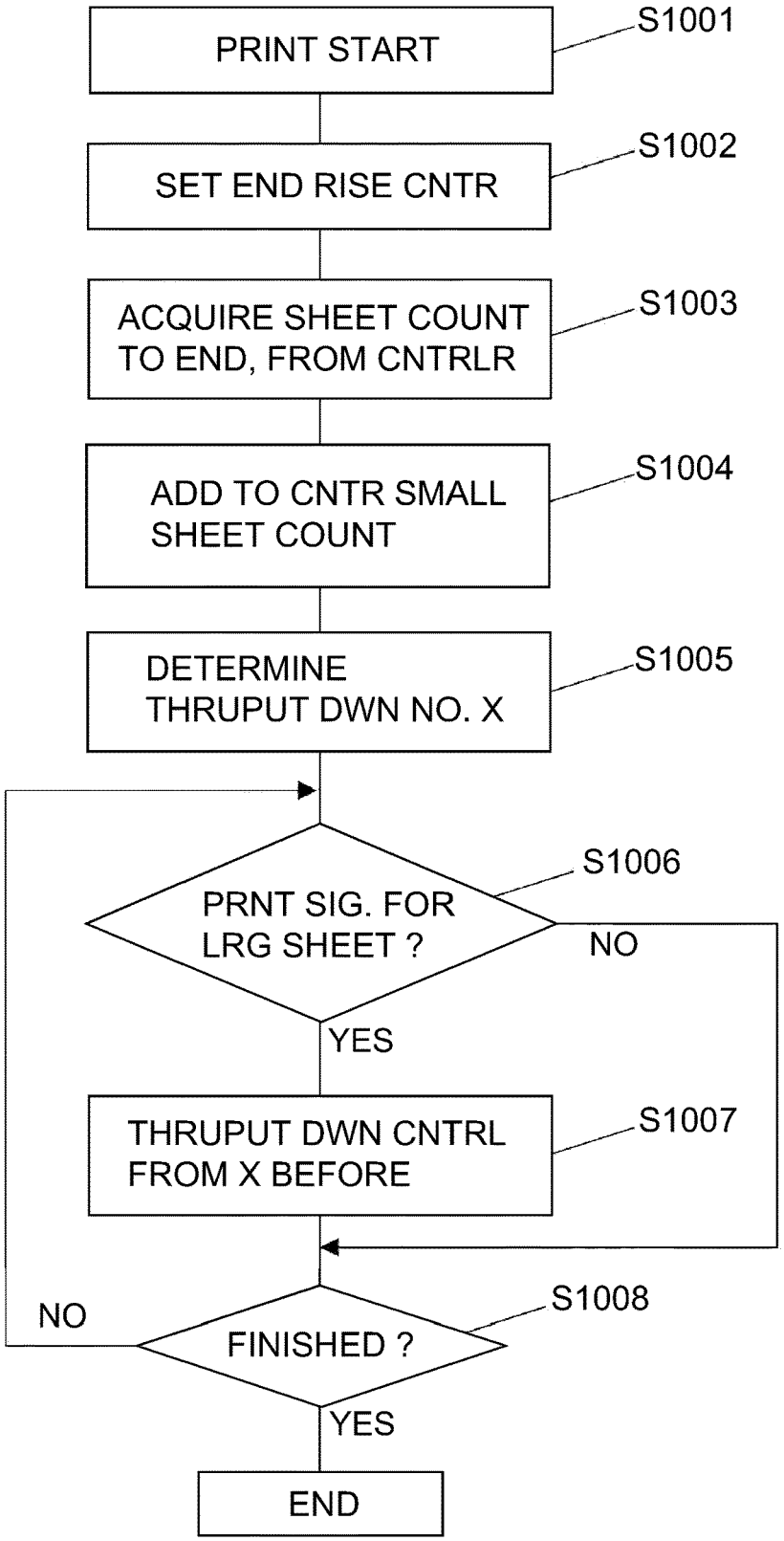
FIG. 4 is a flowchart of the throughput-down control sequence in the first embodiment.

FIG. 4 is a flowchart of the control sequence, in this embodiment, for a printing operation in which small sheets S of paper are conveyed through the fixing portion 130. First, as a printing operation is started in step S1001 in response to an instruction to start a printing operation, the printing operation is started following the flowchart shown in FIG. 4. Next, an end portion overheat counter is set in step S1002. Here, "end portion overheat counter" is a counter for counting small sheets S of paper as the sheets S are conveyed through the fixing portion 130. By the way, the sheet count can be weighted as will be described later.

In this embodiment, a control portion 200 (FIG. 1) decides whether or not the throughput-down control is to be executed, based on an index named end portion overheat counter. This counter is such an index that indicates an approximate temperature difference between the sheet-path portion and out-of-sheet-path portions of the film 133. More concretely, it is set so that the greater the number by which small sheets S of paper are conveyed, the greater it is in value.

Here, in a case in which the temperature difference between the sheet-path portion and out-of-sheet-path portions of the film 133 is expected to be relatively small, for example, in a case in which a printing operation is carried out after large sheets S of paper were conveyed, or in a case in which a printing operation is started after the elapsing of a substantial length of time after the completion of the preceding printing operation, even if the printing operation uses small sheets S of paper as a recording medium, the initial value for the index is set to zero. On the other hand, in a case in which a printing operation begins to be carried out before a substantial length of time elapses after the completion of a printing operation that uses small sheets S of paper as recording medium, the initial value for the index is set according to the number of small sheets S of paper conveyed through the fixing portion 130 and/or the elapsed length of time after the completion of the preceding printing operation.

Next, in step S1003, the control portion 200 receives from the engine controller, the information regarding the sheets S of paper until the printing operation ends. More concretely, the information is the width of sheets S of paper that are going to be conveyed, the number of sheets S of paper that are going to be conveyed (print count set by user), etc. In step S1004, the number of sheets S of paper that are no more than 210 mm in width is added to the value in the end portion overheat counter. In this case, the number of sheets S of paper may be weighted according to the width of the sheets S. That is, the counter may be weighted so that the narrower (smaller) the sheets S, the greater the coefficient of weighting is set.

Next, in step S1005, the value for the throughput-down count X is set according to the end portion overheat counter. Here, "throughput-down count X" is the number (preset number) of sheets S of paper that are to be conveyed through the fixing portion 130 at a throughput of 6 ppm. That is, in this embodiment, in a printing operation in which small sheets S of paper are continuously conveyed, the image forming apparatus 100 is reduced (slowed down) in throughput for the last few (X) sheets S of paper.

Setting a value for the throughput-down count X is equivalent to setting the timing with which the image forming apparatus 100 is to be changed (reduced in speed) in throughput from the first one (15 ppm) to the second one (6 ppm). For example, if the throughput-down count X is set to three by the end portion overheat counter, the timing with which the image forming apparatus 100 is to be changed in throughput is when the leading edge of the eighteenth small sheet S of paper reaches the pair of registration rollers 104 (FIG. 1). Further, the timing is affected by the value in the end portion overheat counter. That is, it is reasonable to say that there are multiple timings with which the image forming apparatus 100 is to be reduced in throughput.

Referring to Table 1, if the amount of the end portion overheating is greater than, or equal to, a referential value (value in end portion overheat counter is 11), the control portion 200 (FIG. 1) changes the image forming apparatus 100 in throughput from the first one to the second one, according to the amount of the end portion overheating. On the other hand, if the amount of the end portion overheating is less than the referential value (11 in end portion overheating counter), the control portion 200 does not change the image forming apparatus 100 in throughput.

TABLE 1

| Counter value | Throughput down No. |
|---|---|
| 0 to 10 | 0 |
| 11 to 16 | 1 |
| 17 to 24 | 2 |
| 25 to 44 | 3 |
| 45 or greater | 4 |

In step S1006, it is determined whether or not there has been received a signal for switching the recording medium from those being used to a recording medium that is wider than those being used. That is, it is determined whether or not there has been received a signal to start using a large sheet S of paper for the on-going image forming operation, in which a substantial number of small sheets S of paper are conveyed (through the fixing portion 130) at the first throughput (15 ppm) as a fixation count per unit length of time.

If the control portion 200 determines that this signal has been received, it proceeds to step S1007. If it determines that the signal has not been received, it proceeds to step S1008. In step S1007, the control portion 200 reduces the image forming apparatus 100 in throughput before it starts conveying the X-th large sheet S of paper (counting backward from the last sheet S of paper in the printing operation, based on the preset throughput-down sheet count. As the image forming apparatus 100 is reduced in speed, the fixing portion 130 improves in image quality, as the film 133 is reduced faster in temperature difference between its sheet-path portion and out-of-sheet-path portions, and amount by which out-of-sheet-path portions of the heater 132 generates heat becomes smaller, because amount by which the heater 132 is supplied with electrical power is reduced. Therefore, it is possible to lower the target temperature for the heater 132.

Next, in step S1008, the control portion 200 determines whether or not the printing operation is completed. If it determines that the operation has not been completed, it returns to step S1006. If it determines that the operation has been completed, it ends the printing operation.

Here, the values for the throughput-down count in Table 1 are set in consideration of the following factors. First, regarding the temperature difference between the sheet-path portion and out-of-sheet-path portions of the film 133 (fixing portion 130), the highest level the temperature difference reaches is affected by the throughput of the image forming apparatus 100 (fixing portion 130). For example, when a substantial number of small sheets S of paper are conveyed at 15 ppm, the temperature difference reached roughly 49° C. When they are conveyed at 6 ppm, the temperature difference reached roughly 24° C.

If the image forming apparatus 100 is reduced in throughput (to 6 ppm) while it is operated at a throughput of 15 ppm and the temperature difference is greater than 49° C., the temperature difference gradually reduces to 24° C., which is the saturation level when the sheets S of paper are conveyed at 15 ppm. The length of time (sheet count) it takes for the temperature difference to come close to the saturation level (preset temperature level at preset amount of pressure) is affected by the temperature difference prior to the starting of the throughput-down control. In this embodiment, therefore, the control portion 200 changes the throughput-down sheet count according to the value of the end portion overheat counter. which shows the temperature difference, so that the image forming apparatus 100 remains highest in productivity.

By reducing the speed at which small sheets S of paper are conveyed following the flowchart described above, it is possible to prevent the out-of-sheet-path portions of the film 133 (fixing portion 130) from overheating, and, therefore, to reduce the length of time necessary to idle the image forming apparatus 100 (to rotate the film 133 and the pressure roller 134) to reduce the length of time necessary to make the fixing portion 130 roughly uniform in temperature. The followings are the tests carried out to confirm these effects.

Test 1

The length of time it took to make it possible for a sheet S of paper of A4 size to be conveyed through the fixing portion 130 without allowing the high temperature offset to occur, after twenty envelopes (COM10 size) were continuously conveyed when the throughput-down control is carried out, was compared with that when the throughput-down control was not carried out. The throughput-down sheet count for the throughput-down control was set according to a table prepared in advance. In step S1001, the tests were started when the fixing device (fixing portion 130) was sufficiently cold. Therefore, the initial value for the end portion overheating counter was set to zero.

Next, in step S1003, the control portion 200 received information that the number of envelopes of COM10 size, which are to be conveyed through the fixing device 130 until the printing operation ends, was 20. In step S1004, a certain value is added to the end portion overheating counter. Envelopes of COM10 size are substantially narrower, however, than a sheet S of paper of A4 size. Therefore, the end portion overheating count was weighted by two. Thus, the end portion overheating counter was 40.

Figure 5:
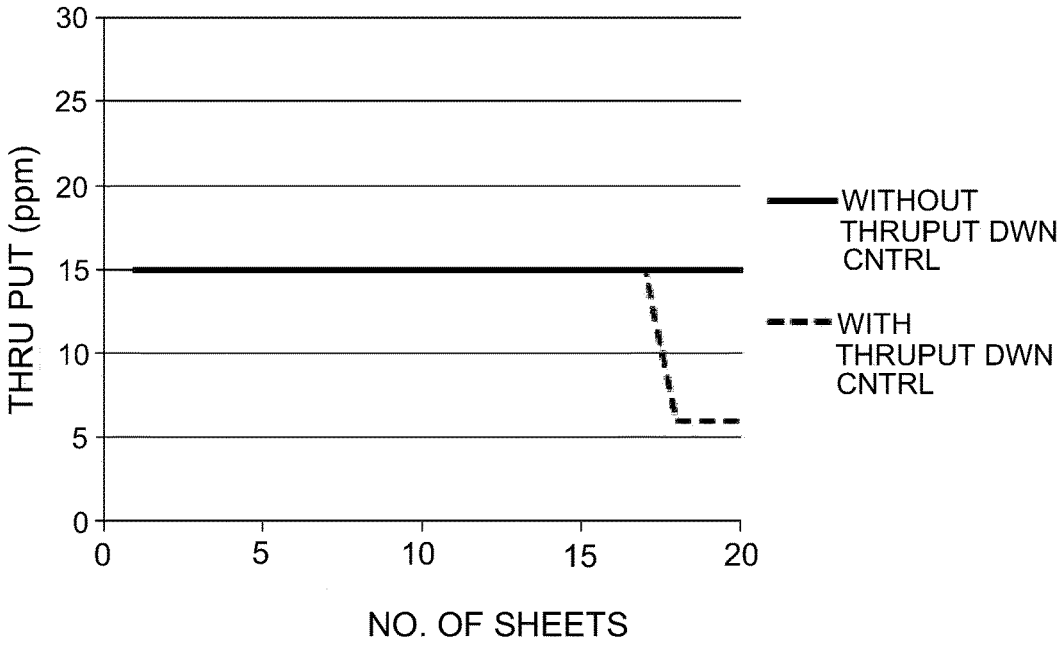
FIG. 5 is a graph showing the relationship between the throughput and the number of sheets conveyed through the fixation nip, when the throughput-down control was carried out and when the throughput-down control was not carried out.

In step S1005, the throughput-down sheet count was set to 3 with reference to Table 1. Therefore, while the first to seventeenth sheets S of paper were conveyed, the image forming apparatus 100 (fixing portion 130) was operated at a throughput of 15 ppm (first throughput), and then, while the eighteenth sheet S and the sheets S thereafter were conveyed, the image forming apparatus 100 was operated at a throughput of 6 ppm (second throughput), as shown in FIG. 5.

Figure 6:
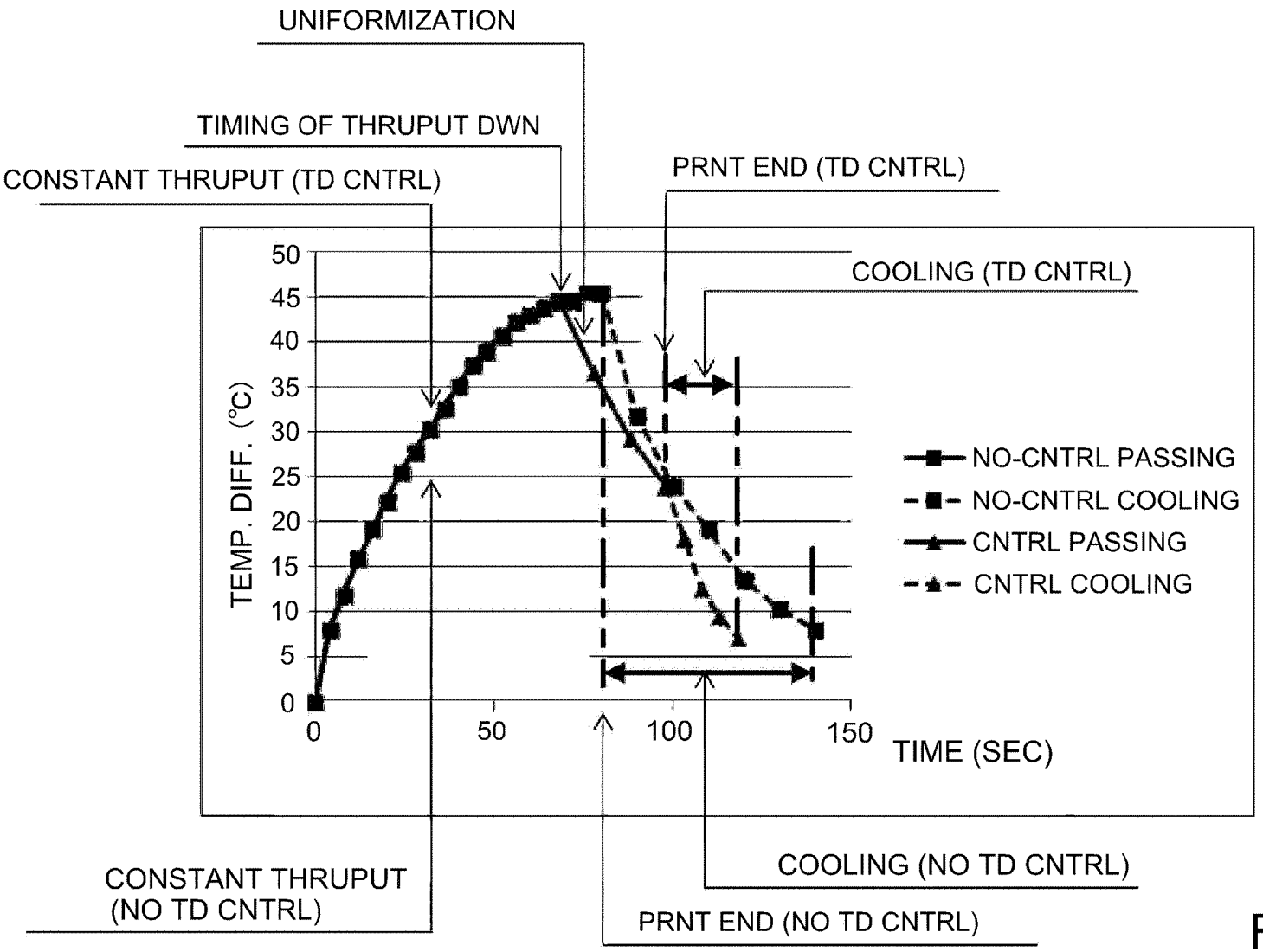
FIG. 6 is a graphical drawing for showing the length by which the total length of time required to complete an image forming operation can be reduced.

Shown is FIG. 6 is the relationship between the temperature difference between the sheet-path portion and out-of-sheet-path portions of the film 133, and the elapsed length of time, when the throughput-down control was carried out and when it was not carried out. First, when the throughput-down control was not carried out, twenty envelopes (small sheets S of paper) were conveyed at 15 ppm (4 seconds per sheet), and the temperature difference reached roughly 45° C. Then, the equalization process (cooling process) was started to rotate the film 133 and the pressure roller 134 to make the film 133 roughly uniform in temperature, until the temperature difference becomes no more than 10° C., below which high temperature offset is unlikely to occur. FIG. 6 shows that it took roughly 60 seconds to reduce the temperature difference to no more than 10° C.

In comparison, when the throughput-down control was carried out, the sheet interval (time) became longer, and the amount by which the heater 132 was supplied with electrical power was reduced, at the eighteenth sheet S and thereafter. Therefore, the temperature difference gradually reduced. By the time when the conveyance of the twentieth sheet S ended (end of printing operation), the temperature difference had reduced to roughly 24° C. When the equalization process (cooling process) was started the temperature difference was 24° C., it took roughly 20 seconds to start printing on the next sheet S.

In both the case in which the throughput-down control was not carried out and the case in which the throughput-down control was carried out, the temperature difference was roughly 24° C. when the elapsed length of time was roughly 100 seconds. Yet, the two cases were different in the rate at which the temperature difference reduced. The following is the reason therefor. That is, although the two cases are the same in the value of the temperature difference, they are different in the absolute value of the difference. This is the reason. To describe in greater detail, in the case in which no throughput-down control was carried out, when roughly 100 seconds had elapsed and the temperature difference was roughly 24° C., roughly 20 seconds had elapsed from the ending of the printing operation. Further, the temperature of the sheet-path portion of the film 133 was 115° C., and that of the out-of-sheet-path portions of the film 133 was 139° C.

In comparison, in the case in which the throughput-down control was carried out, when the temperature difference was roughly 24° C. and roughly 100 seconds had elapsed, it was right after the printing operation ended. Thus, the temperature of the sheet-path portion of the film 133 was 150° C., and that of the out-of-sheet-path portions of the film 133 was 170° C. It is evident from the comparison of the two cases that when there is the throughput-down control, the temperatures of the two portions of the film 133 are greater in absolute value, and, therefore, the temperature difference reduces faster.

Here, the two cases are compared in terms of the length of time necessary to make it possible for a large sheet S of paper to begin to be conveyed after the continuous conveyance of a substantial number of small sheets S of paper. Table 2 shows the length of time it takes to convey the small sheets S of paper, the length of time it takes to idle the film 133 and the pressure roller 134 to reduce the temperature difference, and the total length of time it takes to complete the printing operation, when the throughput-down control is not carried out. It shows also the length of time it takes to convey the small sheets S of paper, the length of time it takes idle the film 133 and the pressure roller 134 to reduce the temperature difference, and the total length of time it takes to complete the printing operation, when the throughput-down control is carried out. In a case in which the throughput-down control is carried out, it takes longer to convey the small sheets S of paper, but the length of time the film 133 and the pressure roller 134 have to be idled to make the film 133 uniform in temperature is less. Thus, the overall length of time to complete the printing operation is shorter.

Further, in a case in which only small sheets S of paper are conveyed (printing command to print image on large sheet S of paper is not issued while images are fixed to small sheets S of paper), the throughput-down control is not carried out. That is, the small sheets S of paper are continuously conveyed at 15 ppm (four seconds per sheet). Therefore, the printing operation can be completed in 80 seconds.

TABLE 2

| | Without Throughput-Down Control | With Throughput-Down Control |
|---|---|---|
| Small size sheet | 80 sec | 98 sec |
| Uniformization | 60 sec | 20 sec |
| Total | 140 sec | 118 sec |

In this embodiment, when the image forming apparatus 100 is used for an image forming operation in which a large sheet S of paper is conveyed immediately after the conveyance of a substantial number of small sheets S of paper, the apparatus 100 can be increased in productivity by carrying out the throughput-down control. Further, in a case in which only small sheets S of paper are conveyed, the throughput-down control is not to be carried out.

In this embodiment, the choice of the throughput to which the image forming apparatus 100 is to be reduced for the throughput-down control is only one (6 ppm). It may be a throughput other than 6 ppm, however, as long as it is no greater than 15 ppm. Further, two or more values may be provided as the throughput choices to which the image forming apparatus 100 is reduced in throughput for the throughput-down control, so that a proper throughput can be selected (according to value of end portion overheat counter).

Further, in this embodiment, the throughput-down control was carried out when the image forming apparatus 100 was operated in a mode in which small sheets S of paper are continuously conveyed at 15 ppm. The throughput-down control can be applied to the image forming apparatus 100, however, when the apparatus 100 is operated in one of the following modes. For example, the throughput-down control may be carried out, as the means for preventing the out-of-sheet-path portions of the film 133 from overheating, when the apparatus 100 is operated in such a mode that the apparatus 100 is gradually reduced in speed while small sheets S of paper are continuously conveyed. For example, it is assumed here that a printing operation is started with the use of small sheets S of paper, and a printing command for printing on a large sheet S of paper is not input while the printing operation is carried out on the small sheets S of paper, and also, that the image forming apparatus 100 is changed in throughput in such a manner that while the first to tenth sheets S of paper are conveyed, the throughput is kept at 15 ppm, while the eleventh to twentieth sheets S of paper are conveyed, the throughput is kept at 12 ppm, while the twenty-first to thirtieth sheets S of paper are conveyed, the throughput is kept at 8 ppm, and while the thirty-first and subsequent sheets S of paper are conveyed, the throughput is kept at 6 ppm. If the control in this embodiment is applied to this case, the printer operates in the following sequence: as an operator gives the printer such an instruction that it is to output 20 prints with the use of small sheets S of paper, the throughput-down count X is set to 5, and if an instruction to print on a large sheet S of paper is input while small sheets S of paper are conveyed, the printer operates at 15 ppm up to the tenth sheet S of paper, 15 ppm up to the fifteenth sheet S of paper, and 12 ppm up to the twentieth sheet S of paper.

Further, in the case of an image forming apparatus 100 that is shared by two or more users, the image forming apparatus 100 may be designed so that it is only when both a printing instruction to use small sheets S of paper, and a printing instruction to use large sheets S of paper, are issued by the same operator, that it is decided whether or not the throughput-down control is to be carried out in a printing operation in which a large sheet S of paper is conveyed immediately after a substantial number of small sheets S of paper are continuously conveyed.

According to this embodiment, the throughput-down control is carried out with preset timing only in a printing operation in which a large sheet S of paper is conveyed immediately after a substantial number of small sheets S of paper are continuously conveyed. Thus, it is possible to reduce the length of time necessary for the equalization process (cooling process), and, therefore, to reduce the total length of time to complete the printing operation. Further, it is possible to keep the image forming apparatus 100 high in productivity in both a printing operation in which only small sheets S of paper are conveyed, and a printing operation in which a large sheet S of paper is conveyed immediately after the conveyance of a substantial number of small sheets S.

Embodiment 2

In the first embodiment, the temperature difference between the sheet-path portion and out-of-sheet-path portions of the film 133 was predicted from the condition under which small sheets S of paper are conveyed, and whether or not the throughput-down control is to be carried out when a large sheet S of paper is conveyed immediately after the continuous conveyance of a substantial number of small sheets S of paper is decided based on the prediction. In the case of a printing operation in which both large sheets S of paper and small sheets S of paper are conveyed in such a manner that a large sheet S of paper and a small sheet S of paper are alternately conveyed, it was sometimes rather difficult to predict the temperature difference. In this embodiment, therefore, in order to more precisely predict the temperature difference between the sheet-path portion and out-of-sheet-path portions of the film 133, the fixing apparatus 100 was provided with a thermistor for measuring the temperature of the out-of-sheet-path portions of the heater 132 (temperature of out-of-sheet-path portions of the fixing portion 130), in addition to the thermistor for adjusting the amount by which electrical power is supplied to the heater 132.

The image forming apparatus 100 and its fixing portion 130 in this embodiment are the same in basic structure as those in the first embodiment. Thus, the structural members of the image forming apparatus 100 and its fixing portion 130 in this embodiment, which are the same in structure as the counterparts in the first embodiment, are given the same referential codes as those given to the counterparts, and are not going to be described here.

Central Thermistor and End Portion Thermistor

Figure 7:
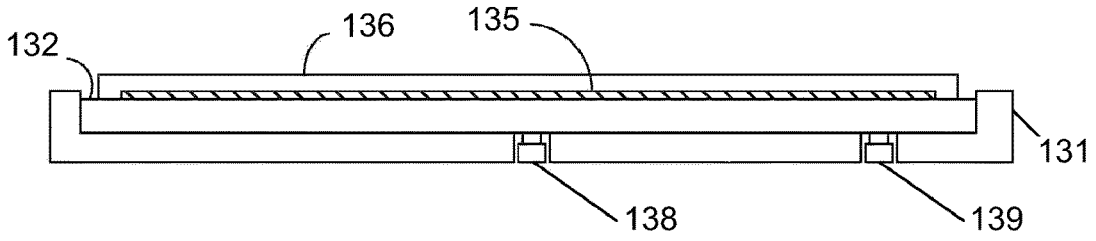
FIG. 7 is a sectional view of the fixing portion in the second embodiment of the present invention, and is for showing the positioning of the two temperature detection elements.

FIG. 7 is a sectional view of a heater 132, which is on the inward side of the loop that the film 133 forms, at a plane that is parallel to the lengthwise direction of the heater 132. The only difference of this embodiment form the first embodiment is that the fixing portion 130 is provided with an end portion thermistor 139 disposed in the adjacencies of one of the lengthwise end portions of the heater 132, in addition to a central thermistor 138 disposed in the adjacencies of the lengthwise center of the heater 132.

Regarding the concrete positional relationship between the central thermistor 138 and end portion thermistor 139 in terms of the lengthwise direction of the fixing portion 130, the dimension of the heat-generating resistor 135 in terms of its lengthwise direction is 222 mm, for example. This dimension of the heat-generating resistor 135 is decided based on the dimension (length) that the heat-generating resistor 135 is required to satisfactorily fix the unfixed toner image on a sheet S of paper even when a largest sheet S of paper, in terms of the lengthwise direction of the fixing portion 130, is conveyed. By the way, the image forming apparatus 100 is structured so that, in terms of the lengthwise direction of its heat-generating resistor 135, when a sheet S of paper is conveyed, its center coincides with the center of the heat-generating resistor 135.

The central thermistor 138 is disposed in the adjacencies of the center of the heat-generating resistor 135 in terms of the lengthwise direction of the heat-generating resistor 135, in order to ensure that it always falls within the sheet-path portion regardless of the size of a sheet S of paper. As for the end portion thermistor 139, it is disposed 105 mm away from the center of the heat-generating resistor 135 in terms of the lengthwise direction of the heat-generating resistor 135, in order to ensure that when a sheet S of paper, which is narrower in terms of the lengthwise direction of the fixing portion 130 than a sheet S of paper of A4 size is conveyed, the temperature of the out-of-sheet-path portions can be measured.

Figure 8:
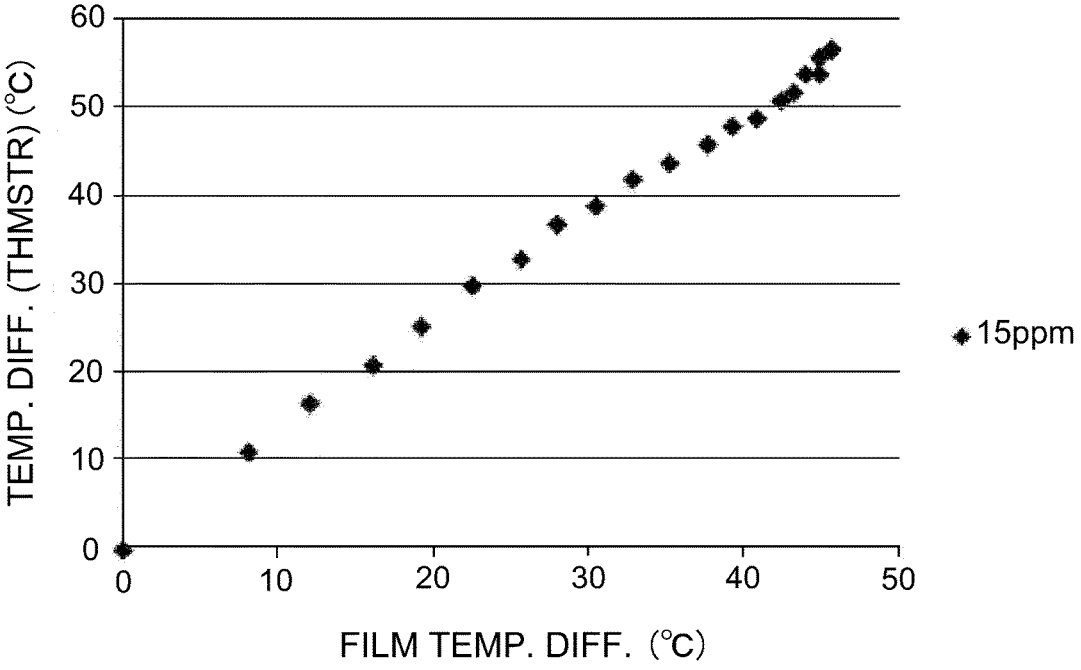
FIG. 8 is a graph showing the relationship between the difference between the temperature detected by one of the two temperature detection elements, and that detected by the other temperature detection element, and the difference between temperature of the sheet-path portion of the fixation film and that of the out-of-sheet-path portions of the fixation film.

FIG. 8 shows the relationship between the temperature difference that occurred between the sheet-path portion and out-of-sheet-path portions of the surface of the film 133 when twenty envelopes of size COM 10 size were continuously conveyed at a throughput of 15 ppm (when small sheets S of paper were continuously conveyed), and the temperature detected by the central thermistor 138 and the temperature detected by the end portion thermistor 139. There is a correlation between the two temperature differences, and, therefore, the temperature difference between the sheet-path portion and out-of-sheet-path portions of the film 133 can be more precisely estimated from the difference between the temperature measured by the central thermistor 138 and that by the end portion thermistor 139 (difference between the temperatures detected by two thermistors, one for one). In this embodiment, therefore, the difference between the temperatures detected by the two thermistors, one for one, was used to more accurately predict the amount of the overheating of the out-of-sheet-path portions of the film 133, than in the first embodiment.

Throughput-Down Control

Figure 9:
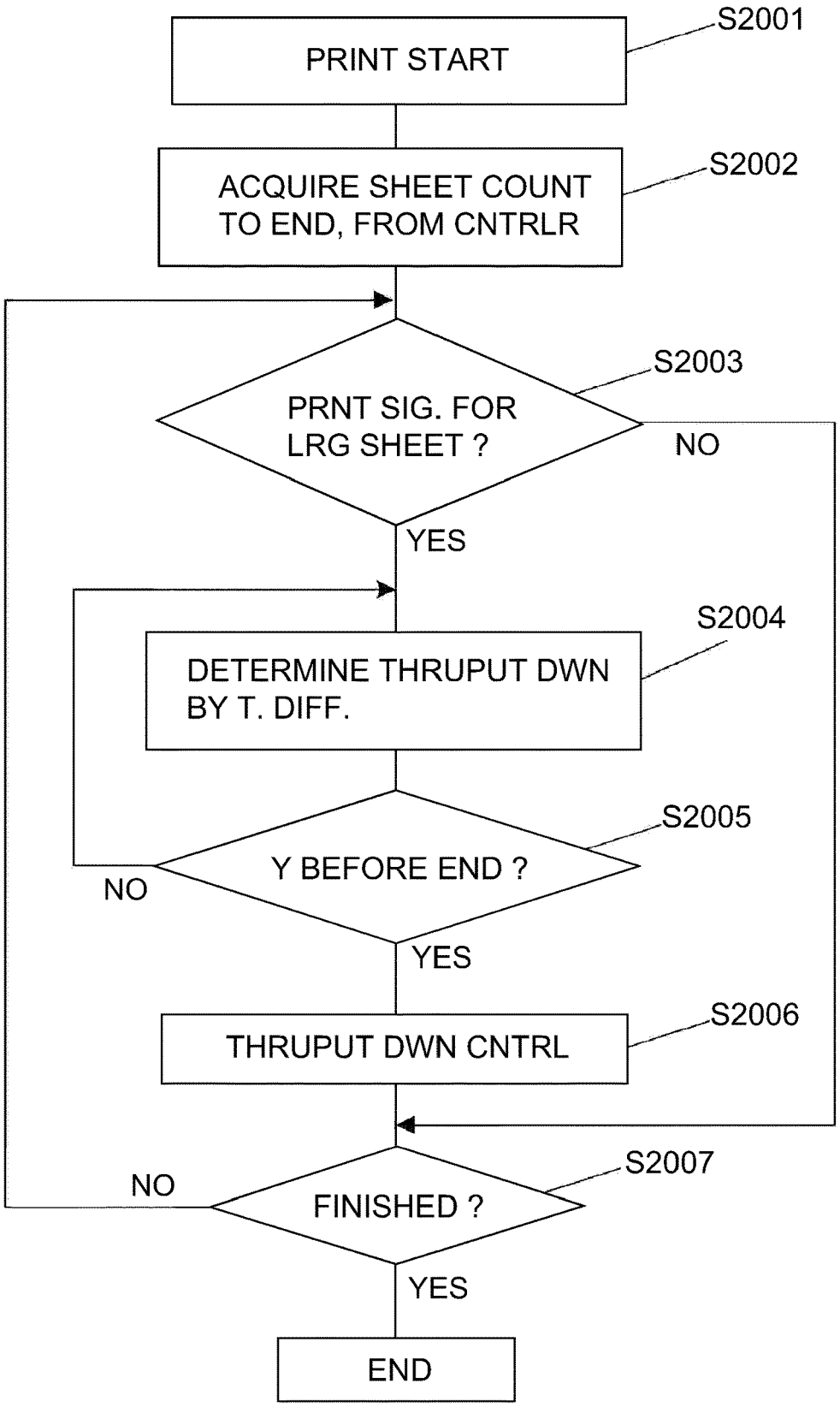
FIG. 9 is a flowchart of the throughput-down control sequence in the second embodiment of the present invention.

FIG. 9 is a flowchart of the throughput-down control sequence in this embodiment. In this embodiment, the difference between the temperature detected by the central thermistor 138 and that detected by the end portion thermistor 139 was used as an index for deciding whether or not the throughput-down control is to be carried out.

Next, the flowchart is concretely described. First, in step S2001, the control portion 200 starts a printing operation in response to a command it received. Next, in step S2002, the control portion 200 receives the information regarding the number of sheets S of paper that are going to be conveyed before the printing operation is completed. In step S2003, it determines whether or not a printing signal for printing on a sheet S of paper that is wider than the sheets S of paper that are currently in use has been received. If it determines that this signal has been received, it proceeds to step S2004. If it determines that the signal has not been received, it proceeds to step S2007.

In step S2004, the control portion 200 selects a value for the throughput-down count Y, according to the difference between the two temperatures detected by the two thermistors, one for one, from a table prepared in advance. Table 3 shows the relationship between the difference between the temperatures detected by the two thermistors, one for one, and the throughput-down count. The greater the temperature difference, the greater the throughput-down count. For example, if the temperature difference is no more than 30° C., the throughput-down count is 0, which means that the throughput-down control is not carried out.

In step S2005, the control portion 200 determines whether or not the printing operation has reached the point at which it begins to print on the Yth sheet S of paper, counting backward from the last sheet S of paper to be conveyed in the printing operation. If it determines that the operation has reached the point at which it begins to print on the Yth sheet S of paper, it proceeds to step S2006 in which it carries out the throughput-down control (TD control). If it determines that the operation has not reached the point, it returns to step S2004, in which it resets the value for the throughput-down count Y. Therefore, this embodiment makes it possible to deal with such a situation that the throughput-down control has to be carried out with earlier timing than expected, due to the overheating of the out-of-sheet-path portions of the film 133. By the way, in the first embodiment, the value for the throughput-down count X was set before the print signal for printing on a sheet S of paper that is wider than the sheets S of paper that are being conveyed, is received. This embodiment makes it possible to set the value for the throughput-down count, after the reception of the print signal to start printing on a sheet S of paper that is wider than the sheets S of paper that are being conveyed.

In step S2007, the control portion 200 determines whether or not the printing operation has been completed. If it determines that the operation has not been completed, it returns to step S2003. If it determines that the operation has been completed, it ends the operation, and it remains at the end of the flowchart.

TABLE 3

| Temperature Difference (°C) | Throughput Down No. |
|---|---|
| <30 | 0 |
| ≥30 and <40 | 1 |
| ≥40 and <49 | 2 |
| ≥49 and <58 | 3 |
| ≥58 | 4 |

According to this embodiment, the film temperature is predicted by following the flowchart described above. Therefore, the film temperature can be more accurately predicted than in the first embodiment, which uses only the end portion overheat counter. For example, in a case in which small sheets S of paper and large sheets S of paper are alternately conveyed, the temperature of the out-of-sheet-path portions of the film 133 does not increase as high as in a case in which only small sheets S of paper are continuously conveyed. The end portion overheating counter is increased, however, by a preset value. Therefore, it is possible that the throughput-down control will be unnecessarily carried out.

In comparison, in this embodiment, in a case in which small sheets S of paper and large sheets S of paper are alternately conveyed, the difference between the temperature detected by the central thermistor 138 and end portion thermistor 139 does not increase, and, therefore, the throughput-down control is not carried out. Therefore, the image forming apparatus 100 remains higher in overall productivity than in the first embodiment.

Modifications

In the foregoing, a couple of preferred embodiments of the present invention were described. These embodiments are not, however, intended to limit the present invention in scope. That is, these embodiments may be variously modifiable within the scope of the present invention. By the way, the measurements, materials, and shapes of the structural components of the image forming apparatus 100 and its fixing portion 130, and their positional relationship, in the preceding embodiments are to be altered according to the structure of the image forming apparatus 100 and its fixing portion 130 to which the present invention is applied, and also, according to the various conditions under which they are used.

Modification 1

In the embodiments described above, in a case in which a command to start conveying a large sheet S of paper is received while a substantial number of small sheets S of paper are continuously conveyed, the throughput-down control was carried out only while a preset number of the last small sheets S of paper, which includes the last sheet S, are conveyed. For example, in a case in which twenty small sheets S of paper are continuously conveyed, the control portion 200 determines, based on the predicted difference in temperature between the central portion and end portions of the film 133 in terms of the widthwise direction of the film 133, that the throughput-down count is 3, the throughput-down control is carried out while the eighteenth to twentieth small sheets S of paper were conveyed.

It is not mandatory, however, that the throughput-down control is carried out while a preset number of last small sheets S of paper, which includes the last small sheets S of paper, are conveyed. For example, if it is determined, based on the predicted difference in temperature between the center portion and end portions of the film 133 in terms of the widthwise direction of the film 133, that the throughput-down count is three, the throughput-down control may be carried out only while the seventeenth to nineteenth small sheets S of paper, which do not include the last small sheet S of paper, are continuously conveyed. In this case, the twentieth small sheet S of paper is to be conveyed at the same throughput as the sixteenth small sheet S of paper and the prior sheets S.

Similarly, it is not mandatory that if it is determined, based on the predicted difference in temperature between the center portion and end portions of the film 133 in terms of the widthwise direction of the film 133, that the throughput-down count is one, the throughput-down control is to be carried out only for the last (twentieth) small sheet S of paper. For example, if it is determined, based on the predicted difference in temperature between the center portion and end portions of the film 133 in terms of the widthwise direction of the film, that the throughput-down count is one, the throughput-down control may be carried out for only one (nineteenth sheet S, for example) of the last small sheets S of paper, which does not include the literally last small sheet S of paper.

Modification 2

The change in throughput from the first one to the second one may be made by changing (reducing) the speed with which recording medium is conveyed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming portion configured to form a toner image on a recording material;

a fixing portion configured to heat and to fix the toner image formed on the recording material; and a controller configured to control said apparatus, which is operable to form an image on a recording material having a first size and a recording material having a second size smaller than the first size in a direction perpendicular to a recording material feeding direction, wherein, if a printing instruction for printing on the recording material of the first size is received while printing is continuously performed on the recording material of the second size at a first throughput, said controller controls said apparatus so as to print on the recording material of the second size at a second throughput, which is lower than the first throughput, before printing on the recording material of the first size.

2. The image forming apparatus according to claim 1, wherein said controller sets a number of prints to be formed at the second throughput in accordance with a number of prints to be formed on the recording material of the second size set by a user.

3. The image forming apparatus according to claim 1, wherein said controller sets a number of prints to be formed at the second throughput, in accordance with the number of prints to be formed on the recording material of the second size before printing on the recording material of the first size.

4. The image forming apparatus according to claim 1, wherein said controller sets a number of prints to be formed at the second throughput, in accordance with a temperature of a portion of said fixing portion through which the recording material of the second size does not pass.

5. The image forming apparatus according to claim 1, wherein said controller sets a number of prints to be formed at the second throughput, in accordance with a difference between a temperature of a portion of said fixing portion through which the recording material of the second size passes, and a temperature of a portion of said fixing portion through which the recording material of the second size does not pass.

6. The image forming apparatus according to claim 1, wherein, in a period between the printing on the recording material of the second size and the printing on the recording material of the first size, a process of uniformizing a temperature of said fixing portion along a longitudinal direction of said fixing portion is carried out.

7. The image forming apparatus according to claim 6, wherein said fixing portion includes a heater, and a first rotatable member and a second rotatable member configured to nip and to feed the recording material, and wherein the process of uniformizing includes rotating said first and second rotatable members while heat generation of said heater is stopped or suppressed, as compared with heat generation during a normal fixing process.

8. The image forming apparatus according to claim 7, wherein said first rotatable member includes a cylindrical film.

9. The image forming apparatus according to claim 8, wherein said heater is in contact with an inner surface of said film.

10. The image forming apparatus according to claim 9, wherein said heater is cooperative with said second rotatable member to provide a fixing nip through said film to nip and to feed the recording material.

11. An image forming apparatus comprising:

an image forming portion configured to form a toner image on a recording material;

a fixing portion configured to heat and to fix the toner image formed on the recording material; and a controller configured to control said apparatus, which is operable to form an image on a recording material having a first size and a recording material having a second size smaller than the first size in a direction perpendicular to a recording material feeding direction, wherein, if said controller receives a printing instruction to print on the recording material of the first size while printing is performed for a manually set number of the recording materials of the second size, said controller sets a second throughput, which is longer than the first throughput, for a remaining predetermined number of recording materials, of the manually set number of the recording materials of the second size, to be printed.

12. The image forming apparatus according to claim 11, wherein said controller sets the predetermined number in accordance with the manually set number of recording materials of the second size.

13. The image forming apparatus according to claim 11, further comprising a temperature detecting element for detecting a temperature of the fixing portion in an area through which the recording material of the second size does not pass, wherein said controller sets the predetermined number in accordance with a temperature detected by said temperature detecting element at a timing with which the printing instruction for printing on the recording material of the first size is received.

14. The image forming apparatus according to claim 11, further comprising:

a first temperature detecting element for detecting a temperature of the fixing portion in an area through which the recording material of the second size passes; and a second temperature detecting element for detecting a temperature of the fixing portion in an area through which the recording material of the second size does not pass, wherein said controller sets the predetermined number in accordance with a difference between a temperature detected by said first temperature detecting element and a temperature detected by said second temperature detecting element at a timing with which the printing instruction for printing on the recording material of the first size is received.

15. The image forming apparatus according to claim 11, wherein, in a period between the printing on the recording material of the second size and the printing on the recording material of the first size, a process of uniformizing the temperature of said fixing portion along a longitudinal direction of said fixing portion is carried out.

16. The image forming apparatus according to claim 15, wherein said fixing portion includes a heater, and a first rotatable member and a second rotatable member configured to nip and to feed the recording material, wherein the process of uniformizing includes rotating said first and second rotatable members while heat generation of said heater is stopped or suppressed, as compared with heat generation during a normal fixing process.

17. The image forming apparatus according to claim 16, wherein said first rotatable member includes a cylindrical film.

18. The image forming apparatus according to claim 17, wherein said heater is in contact with an inner surface of said film.

19. The image forming apparatus according to claim 18, wherein said heater is cooperative with said second rotatable member to provide a fixing nip through said film to nip and to feed the recording material.

* * * * *